US007234444B2

(12) United States Patent
Nanba et al.

(10) Patent No.: US 7,234,444 B2
(45) Date of Patent: Jun. 26, 2007

(54) EMISSION GAS RECYCLING EQUIPMENT HAVING BUTTERFLY VALVE

(75) Inventors: Kunio Nanba, Anjo (JP); Kazuto Maeda, Nagoya (JP); Koji Hashimoto, Kariya (JP)

(73) Assignee: DENSO Corporation (JP)

( * ) Notice: Subject to any disclaimer, the term of this patent is extended or adjusted under 35 U.S.C. 154(b) by 0 days.

(21) Appl. No.: 11/640,408

(22) Filed: Dec. 18, 2006

(65) Prior Publication Data

US 2007/0095334 A1 May 3, 2007

Related U.S. Application Data

(62) Division of application No. 11/059,504, filed on Feb. 17, 2005, now Pat. No. 7,168,682.

(30) Foreign Application Priority Data

Feb. 19, 2004 (JP) ..... 2004-42588

(51) Int. Cl.
*F02D 9/08* (2006.01)

(52) U.S. Cl. ..... 123/337; 251/306

(58) Field of Classification Search ..... 251/305–308, 251/208; 123/337, 399
See application file for complete search history.

(56) References Cited

U.S. PATENT DOCUMENTS 3,809,361 A * 5/1974 Pfundstein et al. ..... 251/305
4,154,426 A * 5/1979 Santy et al. ..... 251/306
4,344,396 A * 8/1982 Yamada ..... 123/337
4,632,360 A * 12/1986 DeSalve ..... 251/307
5,035,214 A 7/1991 Daly et al.
5,081,972 A * 1/1992 Daly et al. ..... 123/337
5,146,887 A 9/1992 Gluchowski et al.
5,374,031 A * 12/1994 Semence et al. ..... 251/305
5,465,756 A 11/1995 Royalty et al.
5,531,205 A 7/1996 Cook et al.
5,669,350 A * 9/1997 Altmann et al. ..... 123/337

(Continued)

FOREIGN PATENT DOCUMENTS

EP 1 420 158 5/2004

(Continued)

OTHER PUBLICATIONS

Korean Office Action dated Aug. 31, 2006 issued in counterpart Korean Application No. 10-2005-0013333 with English translation.

*Primary Examiner*—John Bastianelli
(74) *Attorney, Agent, or Firm*—Nixon & Vanderhye PC

(57) ABSTRACT

Emission gas recycling equipment includes a passage for recycling a part of an emission gas and a control valve for controlling an amount of the part of the emission gas. The control valve includes: a housing having a pipe portion; a butterfly valve accommodated in the pipe portion rotatable in a first direction and a second direction; a seal ring for sealing a clearance; and valve open/close operation means for stopping the butterfly valve at the valve full close position after the valve open/close operation means operates the butterfly valve to open and to close equal to or more than one cycle across the valve full close position at the time when the engine stops or after the engine stops.

9 Claims, 6 Drawing Sheets

U.S. PATENT DOCUMENTS 5,722,366 A * 3/1998 Adachi et al. ..... 123/337
5,992,377 A * 11/1999 Dall'Osso et al. ..... 123/337
6,149,130 A * 11/2000 Thurston et al. ..... 251/306
6,364,287 B1 4/2002 Rauch et al.
6,367,773 B1 4/2002 Ito
6,439,255 B1 * 8/2002 Chamberlain ..... 251/175
6,454,242 B1 * 9/2002 Garrick et al. ..... 251/208
6,739,579 B1 * 5/2004 Rim ..... 251/306
6,932,051 B2 8/2005 Soshino et al.

FOREIGN PATENT DOCUMENTS

EP 1 426 589 6/2004
JP 2001-173464 6/2001
JP 2003-314377 11/2003

* cited by examiner

EMISSION GAS RECYCLING EQUIPMENT HAVING BUTTERFLY VALVE

CROSS REFERENCE TO RELATED APPLICATION

This application is a division of application Ser. No. 11/059,504, filed Feb. 17, 2005 now U.S. Pat. No. 7,168,682, the entire contents of which is hereby incorporated by reference in this application. This application is based on Japanese Pat. App. No. 2004-42588 filed on Feb. 19, 2004, the disclosure of which is incorporated herein by reference.

FIELD OF THE INVENTION

The present invention relates to emission gas recycling equipment having a butterfly valve.

BACKGROUND OF THE INVENTION

Emission gas recycling equipment according to a related art is well-known. In the equipment, an emission gas recycling gas (i.e., EGR gas) as a part of the emission gas flowing through an exhaust pipe of an engine is mixed into an intake air flowing through an intake pipe so that the maximum combustion temperature is reduced. Thus, toxic substance (e.g., a nitrogen oxide) included in the emission gas is reduced. However, when the emission gas is recycled, engine power is reduced, and driving performance of the engine is reduced. Therefore, it is required to control an amount of the recycling emission gas (i.e., an EGR amount), which is recycled into the intake pipe.

In the related art, the equipment includes a recycling emission gas amount control valve for adjusting an opening area of an emission gas recycling passage, which is formed in an emission gas recycling pipe of the emission gas recycling equipment. Here, emission gas recycling equipment using a butterfly valve as a valve body of a recycling emission gas amount control valve is disclosed in, for example, Japanese Unexamined Patent Publication No. H11-502582, which corresponds to U.S. Pat. No. 5,531,205. In this case, the butterfly valve is operated in a rotation direction by a torque motor through a valve shaft. Further, electric control type throttle control equipment using a butterfly valve as a valve body of an airflow amount control valve is disclosed in Japanese Patent Application Publication No. H04-249678, which corresponds to U.S. Pat. No. 5,146,887. In this case, the butterfly valve adjusts an opening area of an inlet passage disposed in an intake pipe connecting to a cylinder of an engine. Thus, the butterfly valve is stopped at a position, at which the valve is rotated by a predetermined angle in a case where the engine is stopped, so that the valve body is prevented from adhering to a bore by a deposit.

In the above prior arts, the butterfly valve rotates around a rotation center axis as a center of the valve shaft. The butterfly valve as the recycling emission gas amount control valve is accommodated in an emission gas recycling passage, in which an emission gas recycling gas (i.e., EGR gas) flows. The EGR gas includes a fine particle such as combustion residual or carbon. Therefore, when the butterfly valve is stopped at the valve full close position in a case where the engine stops, the fine particle in the emission gas recycling gas (i.e., EGR gas) may be adhered to the butterfly valve so that the deposition of the fine particle is occurred. If the deposit of the fine particle is deposited to bridge between the inner diameter surface of the passage and the outer diameter periphery of the butterfly valve, the butterfly valve is not operated smoothly by an actuator such as the torque motor.

In the above case, even if the butterfly valve is operated by energizing the actuator such as the torque motor, for example, in a case where the engine starts, the butterfly valve can not be returned to the valve full close position. Accordingly, the butterfly valve is not operated smoothly by the actuator such as the torque motor after the engine starts. Thus, a possibility of a problem exists, the problem being that the recycling emission gas amount (i.e., EGR amount) cannot be adjusted to correspond to the driving condition of the engine.

Further, another emission gas recycling equipment using a butterfly valve as a valve body of a recycling emission gas amount control valve is disclosed in Japanese Patent Application Publication No. 2003-314377. In this equipment, the butterfly valve has no seal ring, which seals a clearance between the inner diameter surface of a nozzle and an outer diameter surface of the butterfly valve when the butterfly valve is positioned at a valve full close position. Therefore, the butterfly valve is not adhered to an emission gas recycling passage. However, the recycling emission gas amount cannot be precisely adjusted to correspond to the driving condition of the engine, since the butterfly valve is not sealed.

SUMMARY OF THE INVENTION

In view of the above-described problem, it is an object of the present invention to provide emission gas recycling equipment having a butterfly valve to control a recycling emission gas amount precisely.

Emission gas recycling equipment includes: a passage for recycling a part of an emission gas from an exhaust side to an intake side of a combustion engine; and a control valve for controlling an amount of the part of the emission gas, which is recycled into the intake side through the passage. The control valve includes: a housing having a pipe portion to provide a part of the passage; a butterfly valve accommodated in the pipe portion rotatable in a first direction and a second direction, wherein the first direction is defined as a rotational direction of the butterfly valve from a valve full open position to a valve full close position, and the second direction is opposite to the first direction; a seal ring for sealing a clearance between an inner wall of the pipe portion and an outer wall of the butterfly valve in a case where the butterfly valve is positioned at the valve full close position, wherein the seal ring is accommodated in an outer diameter portion of the butterfly valve; and valve open/close operation means for stopping the butterfly valve at the valve full close position after the valve open/close operation means operates the butterfly valve to open and to close equal to or more than one cycle across the valve full close position at the time when the engine stops or after the engine stops.

In the above equipment, the butterfly valve having the seal ring accommodated in the outer diameter thereof is operated to open and to close more than one cycle across a valve full close position when the engine stops or after the engine stops. Thus, a deposition of a fine particle adhered on the inner diameter surface of the pipe portion near the valve full close position can be scraped during the engine runs. After that, the butterfly valve having the seal ring accommodated in the outer diameter is stopped at the valve full close position (i.e., the valve stop position). Thus, the seal ring is elastically deformed toward the inner diameter side of the radial direction so that the outer diameter of the seal ring is prevented from expanding to be larger than the inner diameter of the pipe portion. Further, since the butterfly valve having the seal ring accommodated in the outer diameter is stopped at the valve full close position after the deposit of the fine particle is removed, the seal ring is prevented from being adhered and from an operation failure by an adhesion and a deposition of the fine particle after the engine stops. Thus, the butterfly valve as the recycling emission gas amount control valve can be operated smoothly to open and to close when the engine starts and after the engine starts. Accordingly, the recycling emission gas amount (i.e., EGR amount) can be optimized to correspond to the driving condition of the engine. Thus, the emission gas recycling equipment can control the recycling emission gas amount precisely.

Preferably, the butterfly valve is rotatable in a range between the valve full open position and a predetermined position, at which the butterfly valve is rotated by a predetermined degree from the valve full close position in the first direction. More preferably, the butterfly valve has a circular shape, the seal ring has a ring shape engaged to the butterfly valve, and the pipe portion has a circular cross section, and the butterfly valve with the seal ring is capable of closing the pipe when the butterfly valve is positioned at the valve full close position. Furthermore preferably, the valve open/close operation means rotates the butterfly valve from the valve full open position to the predetermined position across the valve full close position equal to or more than one cycle at the time when the engine stops or after the engine stops. Further, the valve open/close operation means includes a first spring and a second spring. The first spring applies a force to the butterfly valve in the first direction from the valve full open position to the valve full close position, and the second spring applies a force to the butterfly valve in the second direction from the predetermined position to the valve full close position.

Further, emission gas recycling equipment includes: an emission gas recycling passage for recycling a part of an emission gas from a combustion engine to an air intake side of the engine; and a recycling emission gas amount control valve for controlling an amount of the part of the emission gas, which is recycled into the air intake side through the emission gas recycling passage. The recycling emission gas amount control valve includes: a housing having a pipe portion to provide a part of the emission gas recycling passage; a butterfly valve rotatable in a valve opening direction and a valve closing direction with respect to a rotation center axis, wherein the butterfly valve is accommodated in the pipe portion to be openable and closable in a rotational angle range between a valve full open position and a valve stop position, at which the butterfly valve is rotated by a predetermined degree from the valve full open position; a seal ring having a substantially ring shape for sealing a ring shape clearance by using an elastic deformation force in a radial direction, wherein the ring shape clearance is formed between an inner wall of the pipe portion and an outer wall of the butterfly valve in a case where the butterfly valve is positioned at the valve full close position, and wherein the seal ring is accommodated in an outer diameter portion of the butterfly valve; valve position holding means for stopping the butterfly valve at the valve stop position passed over the valve full close position at the time when the engine stops or after the engine stops; and ring outer diameter holding means for holding an outer diameter of the seal ring to be equal to an inner diameter of the pipe portion at the valve stop position.

In the above equipment, the butterfly valve having the seal ring accommodated in the outer diameter of the valve is stopped at the valve full close position during the engine runs. Thus, the ring shaped clearance formed between the inner diameter surface of the pipe portion and the outer diameter surface of the butterfly valve is sealed by using the elastic deformation force of the seal ring in the radial direction. Further, the butterfly valve having the seal ring accommodated in the outer diameter is stopped at the valve stop position passed over the valve full close position when the engine stops or after the engine stops. For example, the butterfly valve is stopped at the valve stop position rotated by a predetermined angle in the valve closing direction from the valve full close position. Further, the equipment further includes ring outer diameter holding means for holding the outer diameter of the seal ring at the valve stop position to be substantially equal to the inner diameter of the pipe portion. Thus, if the deposit of the fine particle is performed to adhere or to deposit so that the seal ring is adhered to the butterfly valve after the engine stops, the butterfly valve having the seal ring accommodated in the outer diameter of the valve can be returned to the valve full close position without stacking the outer diameter periphery of the seal ring to the inner diameter surface of the pipe portion since the outer diameter of the seal ring is almost the same as the inner diameter of the pipe portion. Thus, the butterfly valve as the recycling emission gas amount control valve can be operated to open and to close smoothly after the engine starts. Accordingly, the recycling emission gas amount (i.e., EGR amount) is optimized in accordance with the driving condition of the engine. Thus, the emission gas recycling equipment can control the recycling emission gas amount precisely.

Preferably, the ring outer diameter holding means is a protrusion for limiting an outer diameter of the seal ring not to expand to be larger than the inner diameter of the pipe portion. The protrusion is disposed between the valve full close position and the valve stop position, and disposed on an inner wall of the pipe portion, and the protrusion includes a concavity having a spherical shape corresponding to an outline shape of the seal ring. The concavity is disposed on a top surface of the protrusion.

Preferably, the ring outer diameter holding means has a seal ring construction for limiting an elastic deformation direction of the seal ring to an inner diameter side of the seal ring in a radial direction.

Preferably, the ring outer diameter holding means is outer diameter side deformation limiting means for limiting an elastic deformation of the seal ring to an outer diameter side of the seal ring in a radial direction not to expand the outer diameter of the seal ring larger than the inner diameter of the pipe portion at the valve stop position.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

Figure 6A:
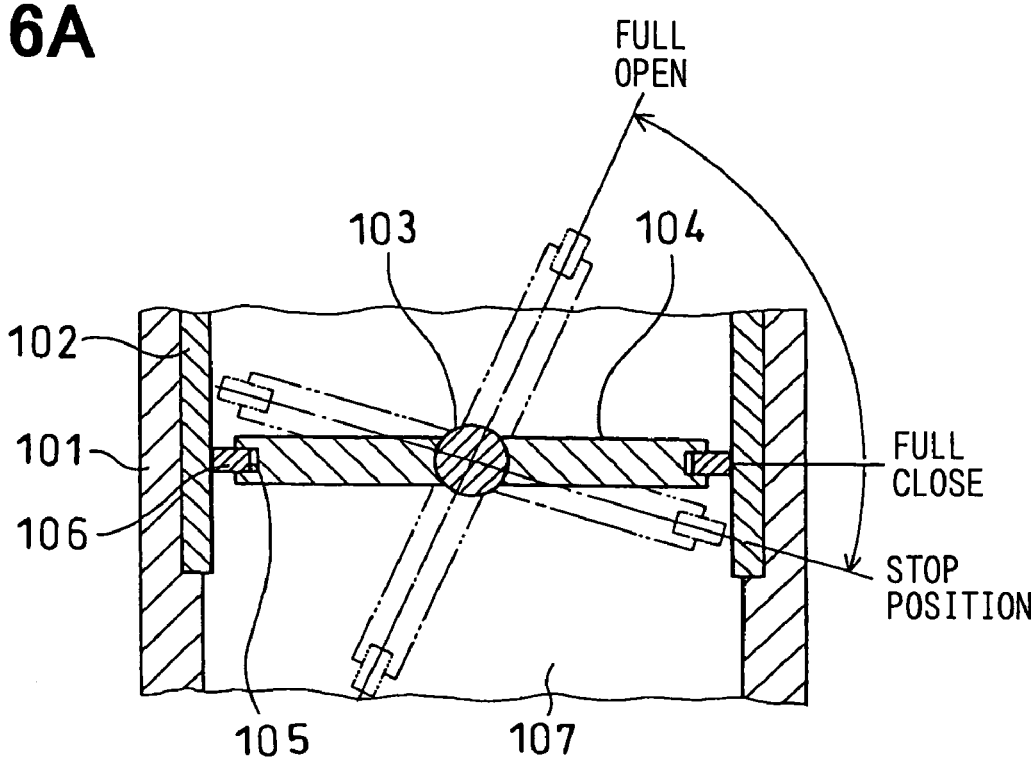
FIGS. 6A and 6B are cross sectional views showing a main part of a recycling emission gas amount control valve in emission gas recycling equipment according to a comparison of the first embodiment.
Figure 6B:
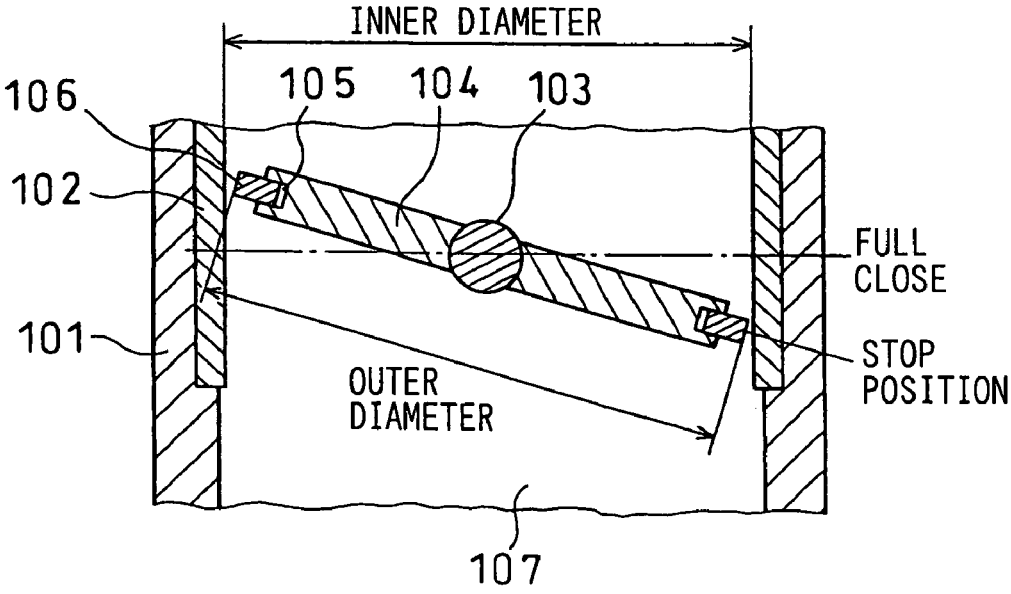

The inventors have preliminarily studies about emission gas recycling equipment having a butterfly valve, which is shown in FIGS. 6A and 6B. A recycling emission gas amount control valve is designed to include a nozzle 102, a valve shaft 103, a butterfly valve 104, and a seal ring 106. The nozzle 102 having a substantially ring shape is engaged to a valve housing 101. The valve shaft 103 is operated by a torque motor. The butterfly valve 104 rotates around a rotation center axis as a center of the valve shaft 103 in the nozzle 102. The seal ring 106 having a substantially ring shape is accommodated in a circumferential groove 105 of the butterfly valve 104. When the butterfly valve 104 is positioned at a valve full close position, the seal ring 106 can seal a ring shaped clearance by using an elastic deformation force in a radial direction of the seal ring 106. The ring shaped clearance is formed between the inner diameter surface of the nozzle 102 and an outer diameter surface of the butterfly valve 104.

The butterfly valve 104 as the recycling emission gas amount control valve is accommodated in an emission gas recycling passage 107, in which an emission gas recycling gas (i.e., EGR gas) flows. The EGR gas includes a fine particle such as combustion residual or carbon. Therefore, when the butterfly valve 104 is stopped at the valve full close position in a case where the engine stops, the fine particle in the emission gas recycling gas (i.e., EGR gas) may be adhered to the butterfly valve 104 and the seal ring 106 so that the deposition of the fine particle is occurred. If the deposit of the fine particle is deposited to bridge between the inner diameter surface of the nozzle 102 and the outer diameter periphery of the seal ring 106, the seal ring 106 may be adhered to the inner diameter surface of the nozzle 102 so that the butterfly valve 104 is not operated smoothly by an actuator such as the torque motor.

Therefore, as shown in FIGS. 6A and 6B, the butterfly valve 104 is stopped at a certain position (i.e., a valve stop position) in a case where the engine stops. At the valve stop position, the butterfly valve 104 having the seal ring 106 accommodated in the outer diameter periphery thereof is rotated by a predetermined angle passed over the valve full close position in a valve closing direction so that the deposit of the fine particle is prevented from depositing to bridge between the inner diameter surface of the nozzle 102 and the outer diameter surface of the seal ring 106. Thus, the inner diameter surface of the nozzle 102 is prevented from adhering to the seal ring 106.

However, a requisite minimum clearance is formed between the inner wall or the bottom of the circumferential groove 105 in the butterfly valve 104 and the sidewall or the inner diameter surface of the seal ring 106 so that the seal ring 106 is easily and elastically deformed toward the outer diameter in the radial direction. When the butterfly valve 104 is stopped at the valve stop position, at which the butterfly valve 104 is rotated by a predetermined angle from the valve full close position in the valve closing direction in a case where the engine stops, the seal ring 106 is elastically deformed toward the outer diameter side in the radial direction so that the outer diameter of the seal ring 106 expands to be larger than the inner diameter of the nozzle 102. In this case, if the deposit of the fine particle is deposited to bridge between the inner wall of the circumferential groove 105 in the butterfly valve 104 and the side wall of the seal ring 106, the seal ring 106 may be adhered to the butterfly valve 104 by the deposit in a state where the seal ring 106 is elastically deformed toward the outer diameter side in the radial direction.

In the above case, even though the butterfly valve 104 is operated by energizing the actuator such as the torque motor, for example, in a case where the engine starts, the butterfly valve 104 can not be returned to the valve full close position. This is because the seal ring 106 is not elastically deformed toward the inner diameter side of the radial direction so that the outer diameter periphery of the seal ring 106 catches on the inner diameter surface of the nozzle 102. Accordingly, the butterfly valve 104 is not operated smoothly by the actuator such as the torque motor after the engine starts. Thus, a possibility of a problem exists, the problem being that the recycling emission gas amount (i.e., EGR amount) cannot be adjusted to correspond to the driving condition of the engine.

Figure 1A:
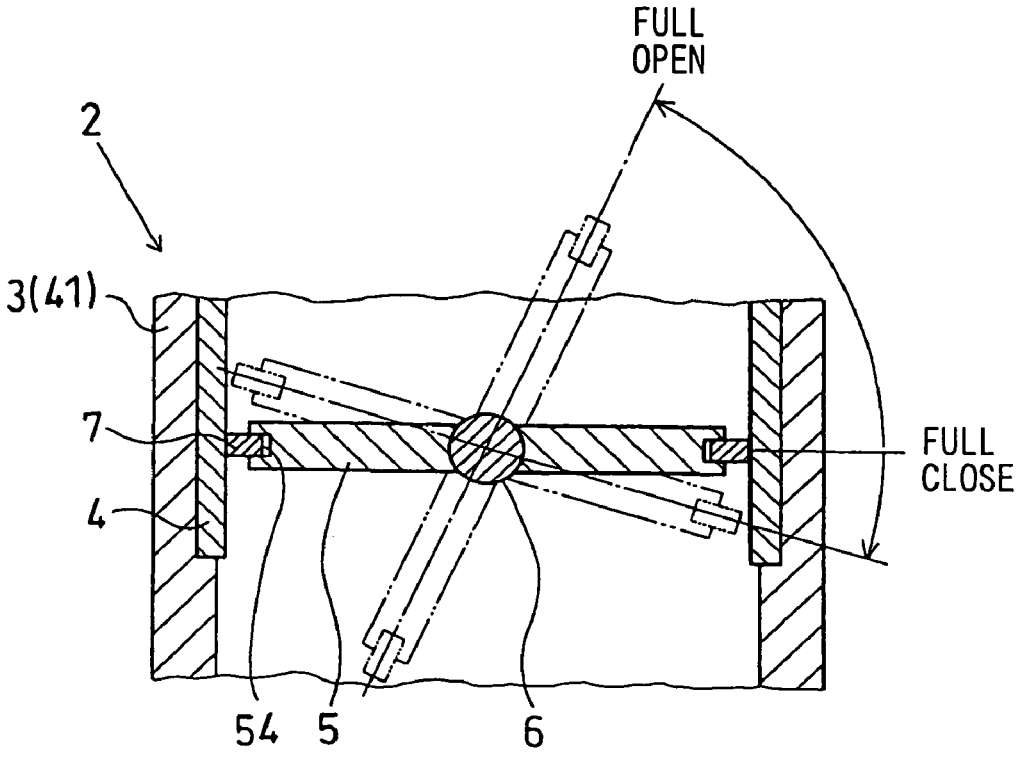
FIGS. 1A and 1B are cross sectional views showing a main part of a recycling emission gas amount control valve in emission gas recycling equipment according to a first embodiment of the present invention.
Figure 1B:
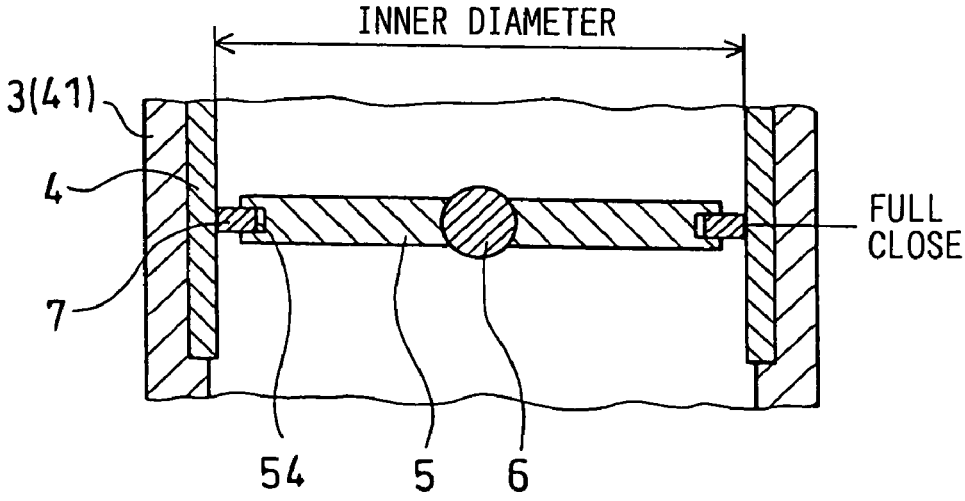
Figure 2:
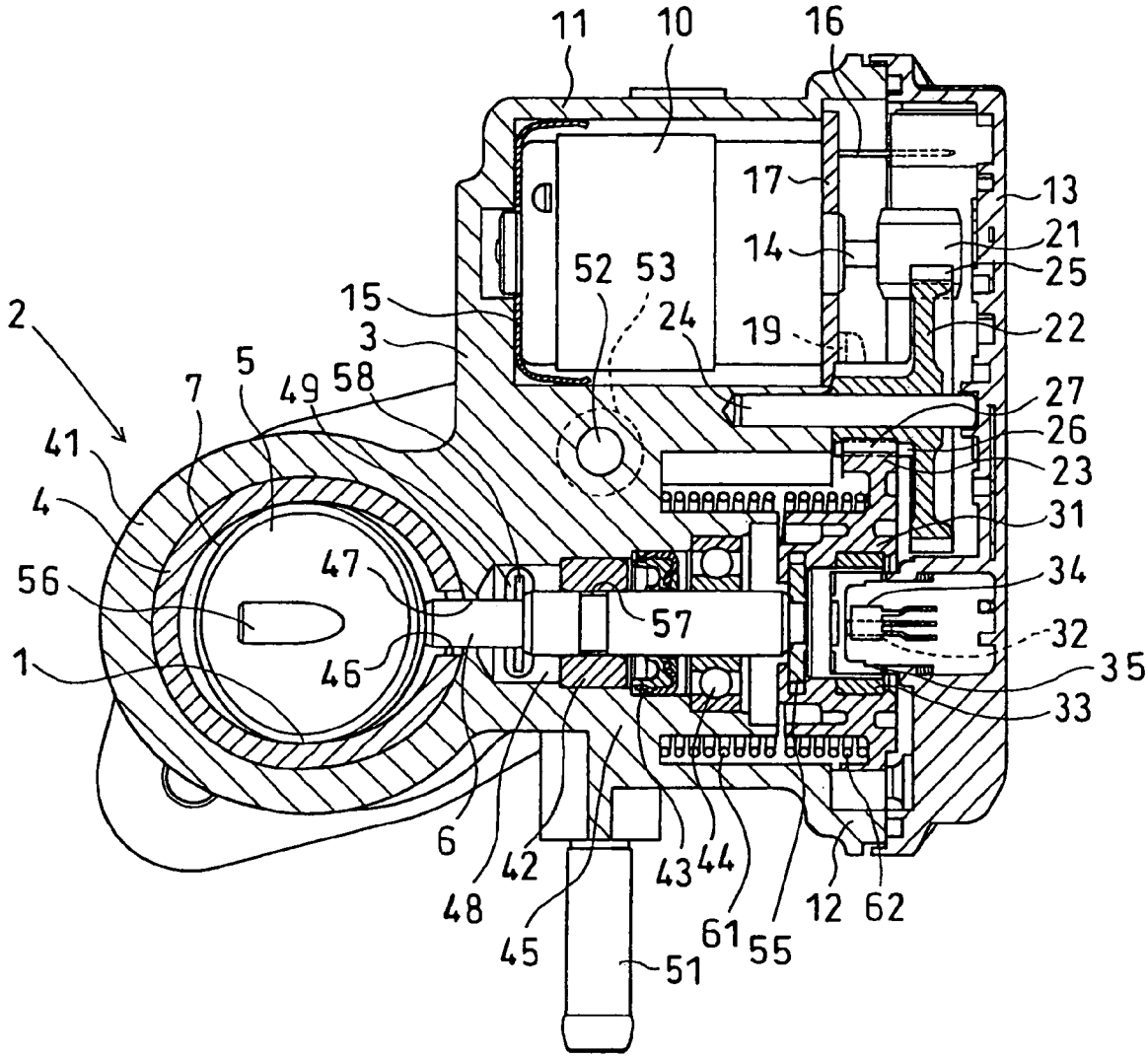
FIG. 2 is a cross sectional view showing a whole construction of the emission gas recycling equipment according to the first embodiment.

In view of the above problem, emission gas recycling equipment having a butterfly valve according to a first embodiment of the present invention is provided. FIGS. 1A, 1B and 2 show the equipment. Specifically, FIGS. 1A and 1B show a main part of the construction of a recycling emission gas amount control valve in the equipment. FIG. 2 shows a whole construction of the emission gas recycling equipment.

The emission gas recycling equipment according to this embodiment includes an emission gas recycling passage 1 and a recycling emission gas amount control valve (i.e., EGR control valve) 2. The emission gas recycling passage 1 connects to an exhaust pipe of a combustion engine (i.e., engine) so that the passage 1 recycles a part of the emission gas (i.e., a recycling emission gas, that is EGR gas) into an intake pipe. The EGR control valve 2 controls a recycling emission gas amount (i.e., EGR amount) recycling from the exhaust pipe to the intake pipe through the emission gas recycling passage 1. The EGR control valve 2 according to this embodiment includes a valve housing 3 and a butterfly valve (i.e., a valve body of the EGR control valve) 5. The valve housing 3 provides a part of the emission gas recycling pipe for recycling the EGR gas from the exhaust pipe to the intake pipe. The butterfly valve 5 is movably accommodated in a nozzle (corresponding to a pipe portion) 4. The butterfly valve 5 is accommodated to be openable and closable. The nozzle 4 having a circular pipe shape is supported to and engaged to the valve housing 3.

The EGR control valve 2 further includes a valve shaft 6 movable together with the butterfly valve 5 in a rotational direction. When the butterfly valve 5 is fully closed, a seal contact surface of a seal ring 7 (i.e., a seal ring outer diameter surface) is press-contacted a seat contact surface of the nozzle 4 (i.e., a nozzle inner diameter surface) by using an elastic deformation force of the seal ring 7 in a radial direction. Thus, a substantially ring shaped clearance formed between the inner diameter surface of the nozzle 4 and the outer diameter surface of the butterfly valve 5 is air tightly closed (i.e., sealed). Here, the seal ring 7 is accommodated in an outer circumference of the butterfly valve 5 (i.e., an outer circumferential surface of an outer diameter periphery of the valve, that is a valve outer diameter surface).

The EGR control valve 2 includes valve open/close operation means, a power unit and an engine control unit (i.e., ECU). The valve open/close operation means operates the butterfly valve 5 to open and to close more than one cycle across a valve full close position when the engine stops. After that, the valve open/close operation means halts the butterfly valve 5 at the valve full close position. The power unit drives the butterfly valve 5 in a valve opening direction (or a valve closing direction). The ECU electrically controls the power unit. Here, the power unit according to this embodiment includes a driving motor 10 and a power transmission system (e.g., a reduction gear system in this embodiment). The driving motor 10 drives the valve shaft 6 in the EGR control valve 2 in the rotational direction. The power transmission system transmits a rotation power of the driving motor 10 to the valve shaft 6 in the EGR control valve 2.

The driving motor 10 is accommodated in a motor housing 11, which has a concave shape, and is formed integrally with an outer wall of the valve housing 3. On the other hand, each gear in the reduction gear system is accommodated in a gear casing 12 rotatably. The gear casing 12 has a concave shape, and is formed integrally with the outer wall of the valve housing 3. A sensor cover 13 is mounted on the outer wall of the valve housing 3. The sensor cover 13 covers an opening side of the motor housing 11 and the opening side of the gear casing 12. The sensor cover 13 is made of resin material (e.g., poly buthylene terephthalate, that is PBT). The sensor cover 13 electrically insulates among terminals of an EGR amount sensor. The sensor cover 13 includes a female joint portion (i.e., bonding surface) for being jointed to a joint portion (i.e., bonding surface), which is formed on the opening side of the motor housing 11 and the opening side of the gear casing 12. The female joint portion is air tightly assembled with the joint portion formed on the opening side of the motor housing 11 and the opening side of the gear casing 12 by using multiple cover fixation screws (not shown).

The driving motor 10 is a direct current motor for rotating a motor shaft 14 (i.e., an output shaft of the driving motor 10) in a case where the motor 10 is energized. The driving motor 10 is integrally connected to an energizing terminal for the driving motor 10, the terminal which is embedded in the sensor cover. An electric actuator (i.e., driving power source) drives to rotate the butterfly valve 5 of the EGR control valve 2 and the valve shaft 6 in the valve opening direction (or the valve closing direction) through the above described reduction gear system. Here, the actuator rotates the motor shaft 14 in a normal rotational direction or an inverse rotational direction when the actuator is energized. In this embodiment, a vibration-proof washer 15 is mounted between the driving motor 10 and the bottom of the motor housing 11. The vibration-proof washer 15 improves vibration-proof of the driving motor 10.

An energizing terminal 16 (i.e., a terminal) for a motor is protruded from a front surface of the driving motor 10. The energizing terminal 16 is electrically and mechanically connected to an external connection terminal (i.e., a terminal, not shown) for the motor. The external connection terminal is embedded in the sensor cover 13. A motor fixation plate 17 is fixed to and screwed to the motor housing 11 with a motor fixation screw 19. The motor fixation plate 17 supports and fixes the driving motor 10 in the motor housing 11.

The reduction gear system reduces a rotation speed of the motor shaft 14 in the driving motor 10 to be a predetermined reduction ratio of speed. The system includes a motor side gear 21, an intermediate reduction gear 22 and a valve side gear 23. The motor side gear 21 is fixed to the outer diameter of the motor shaft 14 of the driving motor 10. The intermediate reduction gear 22 is engaged to and rotates together with the motor side gear 21. The valve side gear 23 is engaged to and rotates together with the intermediate reduction gear 22. Thus, the system provides valve driving means for driving and rotating the valve shaft 6 in the EGR control valve 2. The motor side gear 21 is made of metallic material, and formed integrally to have a predetermined shape. Specifically, the motor side gear 21 is a pinion gear for rotating integrally with the motor shaft 14 of the driving motor 10.

The intermediate reduction gear 22 is made of resin material and formed integrally to have a predetermined shape. The intermediate reduction gear 22 is rotatably engaged to the outer diameter of an intermediate shaft 24. The intermediate shaft 24 provides a rotation center. The intermediate reduction gear 22 includes a large diameter gear 25 and a small diameter gear 26. The large diameter gear 25 is to be engaged to the motor side gear 21, and the small diameter gear 26 is to be engaged to the valve side gear 23. Here, the motor side gear 21 and the intermediate reduction gear 22 are torque transmission means for transmitting a torque of an output shaft of the driving motor 10 to the valve side gear 23. One end of the intermediate shaft 24 (i.e., the right end in FIG. 2) in an axial direction is engaged to a concave portion formed on the inner wall of the sensor cover 13. The other end of the shaft 24 (i.e., the left end in FIG. 2) is press-inserted and fixed to another concave portion formed on the bottom of the gear casing 12. The gear casing 12 is integrally formed on the outer wall of the valve housing 3. The valve side gear 23 is made of resin material (e.g., poly buthylene terephthalate, that is PBT). The valve side gear 23 is formed integrally to have a substantially ring shape. A gear portion 27 is formed on the outer circumferential surface of the valve side gear 23. The gear portion 27 is to be engaged to the small diameter gear 26 of the intermediate reduction gear 22. A rotor 31 is integrally formed on the inner diameter surface of the valve side gear 23. The rotor 31 is made of non-metallic material (e.g., a resin material).

Here, the emission gas recycling equipment according to this embodiment further includes an EGR amount sensor. The EGR amount sensor converts a valve opening degree of the butterfly valve 5 in the EGR control valve 2 to an electric signal so that the EGR amount sensor outputs the electric signal of a recycling emission gas amount (i.e., EGR amount) to the ECU. The EGR amount represents an amount of the EGR gas recycling to the intake pipe, that is an amount of the EGR gas to be mixed to the intake air flowing through the intake pipe. Further, in this embodiment, a driving current inputted to the driving motor 10 is controlled with a feedback control so that a detection EGR amount (i.e., actual valve opening degree) is almost equalized to a command EGR amount (i.e., a target valve opening degree). The command EGR amount is ordered from the ECU. The detection EGR amount is detected by the EGR amount sensor. Preferably, the control of a control command value (i.e., the driving current) for outputting to the driving motor 10 is performed by a duty (i.e., DUTY) control method. The duty (i.e., DUTY) control method is in such a manner that the opening degree of the butterfly valve 5 in the EGR control valve 2 is controlled appropriately by adjusting a ratio between an on time and an off time per unit time in a control pulse signal (i.e., an energizing ratio or a duty ratio) in accordance with a deviation between the command EGR amount (i.e., a target valve opening degree) and the detection EGR amount (i.e., the actual valve opening degree).

The EGR amount sensor includes the rotor 31, a permanent magnet 32, a yoke 33, multiple hall elements 34, a terminal (not shown), and a stator 35. The rotor 31 having a substantially C-shaped cross section is fixed to the right end in FIG. 2 of the valve shaft 6 in the EGR control valve 2. The permanent magnet (i.e., the magnet) 32 is a separate type magnet (having almost cubic shape) as a magnetic field generation source. The yoke 33 (i.e., a magnetic member) is a separate type magnetic member to be magnetized by the magnet 32. The hall elements 34 are integrally disposed on a sensor cover 13 side to face the separate type magnet 32. The terminal is formed of a conductive metallic plate for electrically connecting between an external ECU and the hall elements 34. The stator 35 is made of iron series metallic material (i.e., magnetic material) for concentrating a magnetic flux to the hall elements 34.

The separate type magnet 32 and the separate type yoke 33 are fixed to the inner circumferential surface of the rotor 31 with adhesive or the like. The rotor 31 is integrally formed of resin together with the valve side gear 23, which is one of construction elements of the reduction gear system. The separate type magnet 32 includes multiple parts of the magnets 32 having the almost cubic shape, each of which is disposed to be the same magnetic pole on the same side. Each part has a magnetized direction in the right and left sides in FIG. 2 (specifically, the right side of the drawing becomes the N pole, and the left side of the drawing becomes the S pole). The hall element 34 corresponds to a noncontact magnetic field detection sensor. The hall element 34 is disposed on the inner diameter side of the yoke 33, and each element 34 faces each other. When the magnetic field having the N pole or the S pole is generated on a sensitive surface of the element 34, the hall element 34 detects the magnetic field so that electro motive force (e.g., a positive electric potential is generated in a case where the N pole magnetic field is generated, and a negative electric potential is generated in a case where the S pole magnetic field is generated) is generated. Here, a hall IC or a magneto-resistive sensor can be used for the noncontact magnetic field detection sensor instead of the hall element 34.

The valve housing 3 in the EGR control valve 2 according to this embodiment supports the butterfly valve 5 in the emission gas recycling passage 1 formed in the nozzle 4 in such a manner that the butterfly valve 5 is capable of rotating in a rotational direction in a range between the valve full close position and the valve full open position. The valve housing 3 is screwed and fixed to the intake pipe or the emission gas recycling pipe of the engine with using a cramping member (not shown) such as a bolt. The nozzle 4 is the pipe portion for providing the emission gas recycling passage 1 and for accommodating the butterfly valve 5 to be openable and closable. The nozzle 4 is made of heat resistance material such as stainless steel, which has high temperature stability. The nozzle 41 is formed to be a pipe. On the other hand, the valve housing 3 is made of aluminum alloy, and formed to be a predetermined shape by a die-casting method. A nozzle joint 41 is integrally formed together with the valve housing 3. The nozzle joint 41 is engaged to the nozzle 4 so that the nozzle 4 is supported. Further, a shaft bearing 45 is integrally formed together with the nozzle joint 41. The valve shaft 6 is rotatably supported with the shaft bearing 45 through a bushing 42 (i.e., a bearing), an oil seal 43 (a seal member) and a ball bearing 44 (i.e., a bearing).

The motor housing 11 is formed integrally on the outer wall of the nozzle joint 41 and the shaft bearing 45 shown on the upper side of the drawing in FIG. 2. The motor housing 11 has a concavity for accommodating the driving motor 10 in the power unit. Further, the gear casing 12 is integrally formed on the outer wall of the nozzle joint 41 and the shaft bearing 45 shown on the upper side of the drawing in FIG. 2. The gear casing 12 has a concavity for rotatably accommodating all gears of the reduction gear system in the power unit. The shaft bearing 45 includes a shaft accommodation hole 48 for accommodating the valve shaft 6 rotatably. The shaft accommodation hole 48 connects between the emission gas recycling passage 1 and the gear casing 12 through a shaft accommodation hole 46 formed in the nozzle 4 and another shaft accommodation hole 47 formed in the nozzle joint 41. A connection hole 49 is formed on the left side (i.e., the emission gas recycling passage 1 side) of the drawing in the shaft accommodation hole 48. The connection hole 49 having an oval shape discharges fine particles contained in an emission gas (i.e., EGR gas) to an emission gas recycling pipe by using, for example, a negative pressure of an intake pipe. The fine particles enter from the emission gas recycling passage 1 to the shaft accommodation hole 48 through the shaft accommodation holes 46, 47. The emission gas recycling pipe is disposed on the downstream side of the emission gas from the EGR control valve 2.

A coolant water pipe 51 and another coolant water pipe (not shown) are connected to the valve housing 3. The coolant water pipe 51 flows engine coolant water (i.e., warm water) into a warm water recycling passage. The warm water has a temperature in a predetermined range (e.g., between 75° C. and 80° C.). The warm water recycling passage is formed in the nozzle joint 41 surrounding the nozzle 4, near the valve full close position, or around the emission gas recycling passage 1. The other coolant water pipe flows the warm water out of the warm water recycling passage. The warm water recycling passage disposed between the coolant water pipe 51 and the other coolant water pipe has a bend portion so that the passage bends more than once between the pipes 51 by about 90 degree. The warm water recycling passage includes a warm water recycling passage 52 extending from the front side of the drawing in FIG. 2 to the back side of the drawing. A warm water plug 53 is embedded water-tightly in both ends or one end of the warm water recycling passage 52.

The butterfly valve 5 is made of heat resistant material having high temperature stability such as stainless steel. The valve 5 is formed to be a substantially disk shape. The valve 5 is a butterfly type rotary valve (i.e., a valve member in the EGR control valve 2) for controlling the EGR amount of the EGR gas to be mixed into the intake air flowing through the air intake pipe. The valve 5 is fixed to and mounted on the top end (i.e., the left side of the drawing) of the valve shaft 6. The valve 5 is operated to open and to close in a rotation angle range between the valve full close position and the valve full open position on the basis of a control signal outputted from the ECU when the engine runs. Thus, the butter fly valve 5 controls the EGR amount recycling in the emission gas recycling passage 1 from the air exhaust side to the air intake side by changing an open area of the emission gas recycling passage 1 in the nozzle 4. A circumferential groove 54 (i.e., a seal ring groove, or a ring groove) is formed on a periphery surface of the outer diameter (i.e., a valve outer diameter surface) of the butterfly valve 5 in the radial direction. The groove 54 is formed continuously in the circumferential direction. The groove 54 has a ring shape. The seal ring 7 is accommodated in the groove 54 movably in a thickness direction perpendicular to the radial direction of the seal ring 7 so that the seal ring 7 is capable of moving to the outer diameter side and the inner diameter side of the radial direction. Here, the valve full close position is defined as the minimum valve opening degree (i.e., θ equals zero), at which the clearance between the outer circumferential surface (i.e., the valve outer diameter surface) disposed on the outer diameter periphery of the butterfly valve 5 and the inner circumferential surface (i.e., the nozzle inner diameter surface) of the nozzle 4 becomes minimum. The valve full open position is defined as the maximum valve opening degree (i.e., θ is in a range between 70° and 90°), at which the clearance between the outer circumferential surface (i.e., the valve outer diameter surface) disposed on the outer diameter periphery of the butterfly valve 5 and the inner circumferential surface (i.e., the nozzle inner diameter surface) of the nozzle 4 becomes maximum.

The valve shaft 6 is made of heat resistance material such as stainless steel, which has high temperature stability. The shaft 6 is integrally formed so that the shaft 6 is supported with the shaft bearing 45 rotatably or slidably. A crimped fixation portion is integrally formed on the backside (i.e., the right side of the drawing) of the valve shaft 6. The crimped fixation portion fixes a valve gear plate 55 by using fixation means such as cramping means. The valve gear plate 55 is formed in the valve side gear 23 and in the rotor 31 by an insert molding method. The valve side gear 23 is one of constitution elements in the reduction gear system. The rotor 31 is one of constitution elements in the EGR amount sensor. The valve gear plate 55 is also made of heat resistant material having high temperature stability such as stainless steel, similar to the valve shaft 6. The valve gear plate 55 has a substantially ring shape.

The top end (i.e., the left side of the drawing) of the valve shaft 6 protrudes from the shaft accommodation hole 48 in the shaft joint 45 into the emission gas recycling passage 1 through the shaft accommodation holes 46, 47. A valve mount 56 is formed on the top end of the valve shaft 6. The valve mount 56 holds and fixes the butterfly valve 5 by using fixation means such as welding means. A circumferential groove 57 is formed on the outer circumference (e.g., the outer circumference of the large diameter portion) of the valve shaft 6. The circumferential groove 57 for trapping abrasion powder traps the abrasion powder, which is generated by sliding and abrading between the outer circumferential surface of the valve shaft 6 and the inner circumferential surface of the bushing 42. Thus, the valve shaft 6 is protected from failure of sliding. The sliding failure is occurred by penetrating the abrasion powder into the sliding portion between the outer circumferential surface of the valve shaft 6 and the inner circumferential surface of the bushing 42.

Further, a sleeve 58 is mounted on the outer circumference (e.g., the outer circumference of the small diameter portion) of the valve shaft 6. The sleeve 58 has a ring shape. The sleeve 58 prevents the fine particle contained in the emission gas (i.e., the EGR gas) from depositing on the bushing 42 to form the deposit. The fine particle penetrates into the shaft accommodation hole 48 from the emission gas recycling passage 1 through the shaft accommodation holes 46, 47. The sleeve 58 provides a labyrinth (i.e., intricate path) in the shaft accommodation hole 48 so that the fine particle penetrated in the shaft accommodation hole 48 is prevented from flowing into the bushing 42 side. Further, the fine particle is prevented from discharging from the connection hole 49. The fine particle is contained in the emission gas (i.e., the EGR gas). Accordingly, the sliding failure of the valve shaft 6 is prevented. The sliding failure is occurred by forming the deposit between the valve shaft 6 and the bushing 42.

The seal ring 7 made of heat resistance material such as stainless steel, which has high temperature stability, similar to the butterfly valve 5. The seal ring 7 is formed to have a substantially ring shape. The seal ring 7 is accommodated in the circumferential groove 54 of the butterfly valve 5 in the thickness direction in such a manner that the inner diameter periphery of the seal ring 7 is movable in the radial direction. Further, the outer diameter periphery of the seal ring 7 protrudes from the outer diameter surface of the butterfly valve 5 to the outer diameter side in the radial direction. A sealing contact surface is formed on the outer diameter surface of the outer diameter periphery of the seal ring 7. The sealing contact surface contacts the inner diameter surface (i.e., the sheet contact surface) of the nozzle 4 when the butterfly valve 5 is fully closed.

Figure 3A:
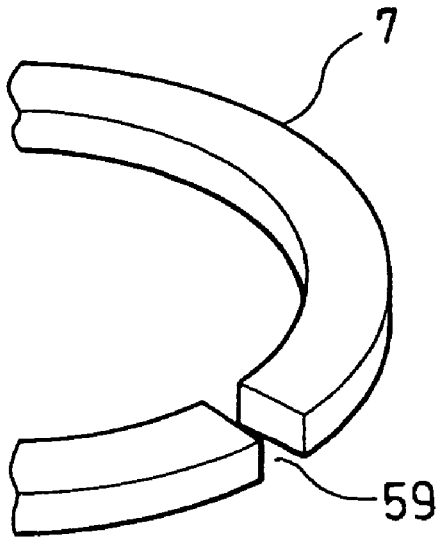
FIGS. 3A to 3D are perspective views showing different shapes of joint surface of a seal ring, according to the first embodiment.
Figure 3C:
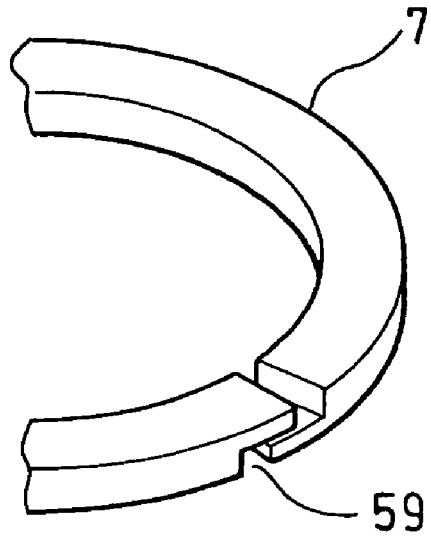
Figure 3B:
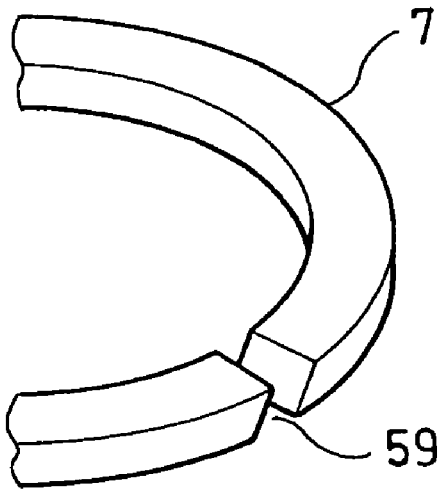
Figure 3D:
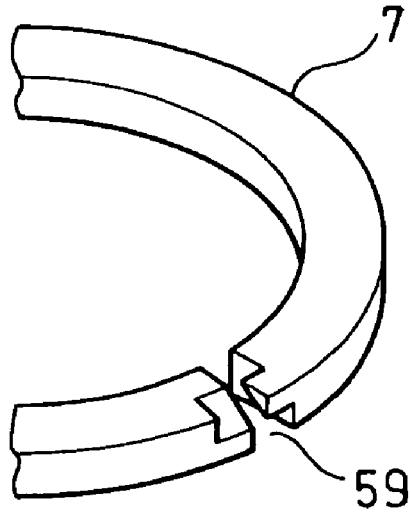

The seal ring 7 is formed to have a substantially C-shape. The seal ring 7 includes a predetermined clearance disposed at an abutment joint 59 in a case where the seal ring 7 is expanded. The shape of the abutment joint 59 of the seal ring 7 can be any shape such as a pad joint shape shown in FIG. 3A, a taper joint shape shown in FIG. 3B, a rap joint shape shown in FIG. 3C and another rap joint shape shown in FIG. 3D. The shape (i.e., the top end shape) of the outer diameter periphery of the seal ring 7 is a certain shape (e.g., a convexity shape) capable of scraping the fine particle in the emission gas depositing on the inner diameter surface (i.e., the sheet contact surface) of the nozzle 4 near the valve full close position of the butterfly valve 5 to form the deposit.

The valve open/close operation means according to this embodiment is mounted between a ring shape concavity of the gear casing 12 and another ring shape concavity of the valve side gear 23. The gear casing 23 is integrally formed on the outer wall of the valve housing 3. The valve side gear 23 is integrated with the right side of the drawing of the valve shaft 6. The valve open/close operation means is provided by one coil spring, which is formed in such a manner that a return spring 61 and a default spring 62 are integrated each other, and that one end of the return spring 61 and one end of the default spring 62 are twisted in different directions. The other end of the return spring 61 and the other end of the default spring 62 are connected. This connection includes a U-shape hook (not shown). The U-shape hook is supported with a valve full close stopper (not shown) when the engine stops.

The return spring 61 is hooked on the ring shape concavity (i.e., a housing side hook), one end of which is disposed on the gear casing 12. The return spring 61 is the first spring for applying a force to the butterfly valve 5 in a returning direction from the valve full open position to the valve full close position. The return spring 61 is engaged to the outer diameter side (i.e., the outer circumferential side) of an inner circumferential spring guide in the radial direction. The inner circumferential spring guide has a substantially cylindrical shape, and is disposed on the inner circumferential side of the ring shape concavity of the gear casing 12. The default spring 62 is hooked on the ring shape concavity (i.e., a gear side hook), one end of which is disposed on the valve side gear 23. The default spring 62 is the second spring for applying a force to the butterfly valve 5 in a returning direction from a position passed over the valve full close position to the valve full close position. The default spring 62 is engaged to the outer diameter side (i.e., the outer circumferential side) of an inner circumferential spring guide in the radial direction. The inner circumferential spring guide has a substantially cylindrical shape, and is disposed on the inner circumferential side of the ring shape concavity of the valve side gear 23. Here, the return spring 61 and the default spring 62 can be unconnected.

[Operation of Equipment]

Next, an operation of the emission gas recycling equipment according to this embodiment is briefly described with reference to FIGS. 1A to 3D.

For example, when an engine such as a diesel engine starts, an air intake valve of an air intake port in a cylinder head of the engine is opened. Then, an intake air filtered with an air cleaner flows through the intake pipe and a throttle body, and then, the air is distributed to an intake manifold of each cylinder of the engine. Thus, the air is sucked into each cylinder of the engine. Then, in the engine, the air is compressed until the temperature of the air becomes higher than a temperature, at which the fuel burns. Then, the fuel is injected into the air so that combustion is performed. The fuel gas burned in each cylinder is discharged from the exhaust port of the cylinder head, and then, the fuel gas is exhausted through an exhaust manifold and an exhaust pipe. At this time, the driving motor 10 is energized by the ECU so that the butterfly valve 5 of the EGR control valve 2 becomes a predetermined opening degree. Then, the motor shaft 14 of the driving motor 10 is rotated.

When the motor shaft 14 rotates, the motor side gear 21 is rotated so that a torque is transmitted to the large diameter gear 25 in the intermediate reduction gear 22. The small diameter gear 26 is rotated around the intermediate shaft 24 as a rotation center in accordance with the rotation of the large diameter gear 25. Then, the valve side gear 23 having the gear portion 27 is rotated with the small diameter gear 26. The gear portion 27 is engaged to the small diameter gear 26. Thus, since the valve side gear 23 rotates around the valve shaft 6 as a rotation center, the valve shaft 6 is rotated by a predetermined rotation angle so that the butterfly valve 5 in the EGR control valve 2 is rotated and operated in a valve opening direction (i.e., an opening direction) from the valve full close position to the valve full open position. Accordingly, a part of the emission gas in the engine is recycled into the emission gas recycling passage 1 as the EGR gas through the exhaust gas recycling pipe. The emission gas recycling passage 1 provides the valve housing 3 and the nozzle 4. The EGR gas flown into the emission gas recycling passage 1 flows into the air intake passage in the intake pipe so that the EGR gas is mixed to the intake air sucked from the air cleaner.

The EGR amount of the EGR gas is controlled by the feedback control method in such a manner that the EGR amount can be kept at a predetermined amount on the basis of the detection signal outputted from the intake air amount sensor (i.e., an air flow meter), the intake air temperature sensor and the EGR amount sensor. Accordingly, the intake air passing through the intake pipe to be sucked into each cylinder of the engine is controlled to be a predetermined EGR amount predetermined by each engine driving condition for reducing the emission. Specifically, the opening degree of the butterfly valve 5 in the EGR control valve 2 is linearly controlled. Thus, the EGR gas recycled in the intake pipe from the exhaust pipe through the emission gas recycling passage 1 is mixed to the intake air.

On the other hand, when the engine stops, the application force of the return spring 61 applied to the valve side gear 23 firstly, so that the valve side gear 23 rotates around the valve shaft 6 as a rotation center, as shown in FIG. 1A. Thus, the valve shaft 6 is rotated by a predetermined rotation angle so that the butterfly valve 5 is rotated from the valve full open position to a certain position, which is defined that the valve 5 passes over the valve full close position to rotate by a predetermined opening degree from the valve full close position in the valve closing direction. When the butterfly valve 5 is rotated from the valve full open position to the certain position passed over the valve full close position and rotated by the predetermined opening degree from the valve full close position in the valve closing direction, the application force of the default spring 62 is applied to the valve side gear 23. Thus, the valve side gear 23 is rotated around the valve shaft 6 as a rotation center, as shown in FIGS. 1A and 1B. Accordingly, the valve shaft 6 is rotated by a predetermined rotation angle so that the valve side gear 23 is returned to the valve full close position.

Thus, since the outer diameter surface (the seal contact surface) of the seal ring 7 is pressed to the inner diameter surface (i.e., the sheet contact surface) by the elastic deformation force of the seal ring 7 itself in the radial direction, the outer diameter surface of the seal ring 7 is attached firmly to the inner diameter surface of the nozzle 4. The seal ring 7 is accommodated in the circumferential groove 54 of the butterfly valve 5. Accordingly, the inner diameter surface of the nozzle 4 and the outer diameter surface of the butterfly valve 5 are air-tightly sealed (i.e., sealed). Therefore, the EGR gas does not penetrate into the air intake passage of the intake pipe. That is, since the butterfly valve 5 according to this embodiment is designed to stop the valve full close position when the engine stops, the outer diameter of the seal ring 7 does not expand to be larger than the inner diameter of the nozzle 4.

[Effect of Equipment]

Thus, in the emission gas recycling equipment according to this embodiment, the butterfly valve 5 is operated to open and to close more than one cycle across the valve full close position when the engine stops. Then, the butterfly valve 5 is stopped at the valve full close position. These are performed by the return spring 61 and the default spring 62. Accordingly, the butterfly valve 5 is operated to open and to close more than one cycle across the valve full close position when the engine stops. The valve full close position is the valve stop position after the engine stops. Therefore, the fine particle in the emission gas forming the deposit by depositing and adhering to the inner diameter surface (i.e., the sheet contact surface) of the nozzle 4 near the valve full close position is scraped and removed by the top end of the seal ring 7, which is accommodated in the circumferential groove 54 of the butterfly valve 5. After that, the butterfly valve 5 is stopped at the position, at which the deposit and the like are scraped and removed. Therefore, the fixation and/or the operation failure of the seal ring 7 caused by the adhesion and the deposition of the deposit after the engine stops is prevented. Accordingly, the butterfly valve 5 is operated to open and to close smoothly when the engine starts or after the engine starts; and therefore, the emission gas recycling amount (i.e., the EGR amount) can be optimized in accordance with the driving condition of the engine.

Here, the shape of the outer diameter periphery (the top end shape) of the seal ring 7 according to this embodiment facilitates the operation of the butterfly valve 5 to open and to close easily more than one cycle across the valve full close position. This is, the top end shape is designed in such a manner that the outer diameter periphery of the seal ring 7 does not catch on the inner diameter surface of the nozzle 4. This facilitation is provided by chamfering an edge of the outer diameter periphery of the seal ring 7 to be a R-shape edge. The edge of the seal ring 7 is disposed on the upstream side of the emission gas flowing direction and on the downstream side of the emission gas flowing direction when the butterfly valve 5 is positioned at the valve full close position.

Further, in this embodiment, the butterfly valve 5 is stopped at the valve full close position by using the return spring 61 and the default spring 62 when the engine stops. The butterfly valve can be operated to open and to close more than one cycle across the valve full close position by using a power unit such as a driving motor when the engine stops. After that, the butterfly valve is operated by the power unit to stop at the valve full close position.

Second Embodiment

Figure 4A:
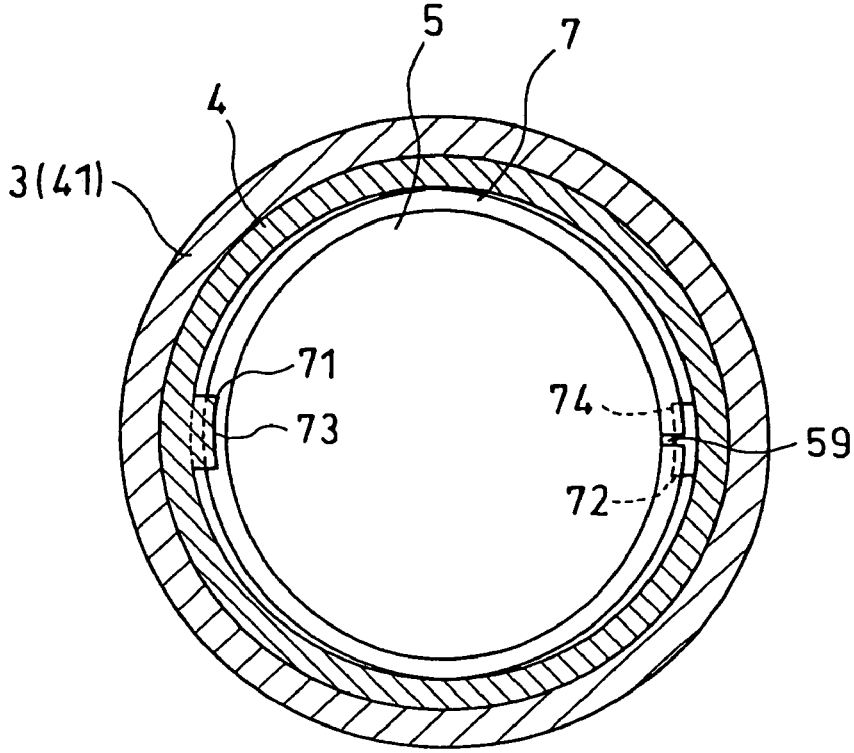
FIGS. 4A and 4B are cross sectional views showing a main part of a recycling emission gas amount control valve in emission gas recycling equipment according to a second embodiment of the present invention.
Figure 4B:
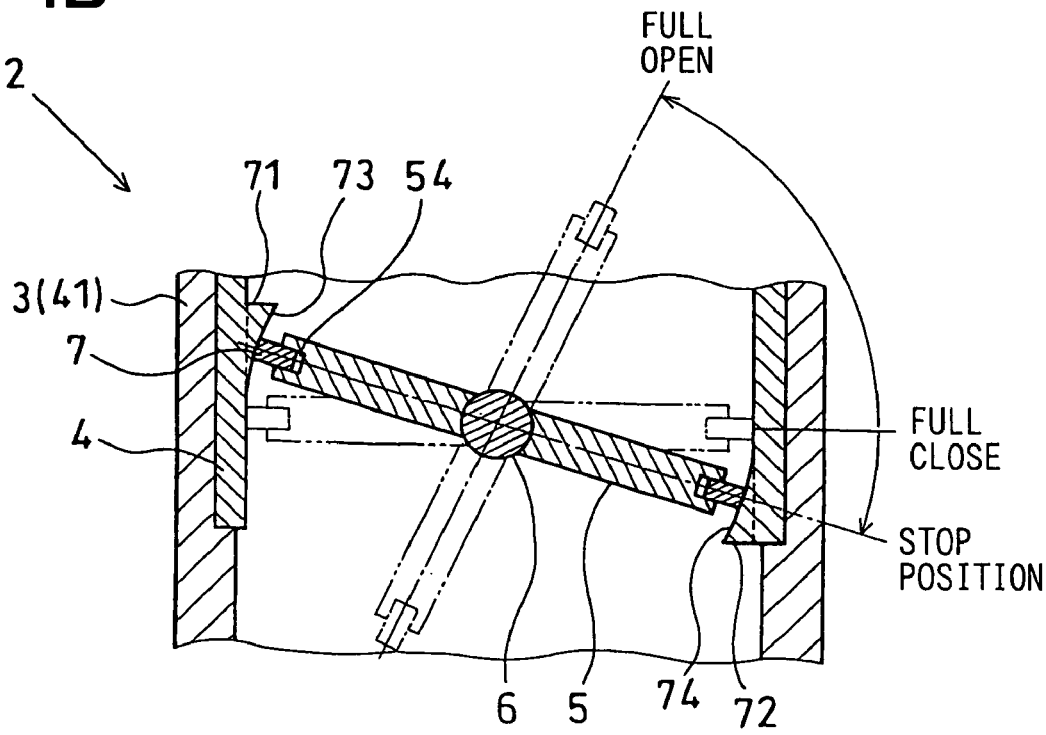

FIGS. 4A ands 4B show a main part of an emission gas recycling amount control valve in emission gas recycling equipment according to a second embodiment of the present invention.

The emission gas recycling equipment according to this embodiment includes a return spring (not shown) as valve position holding means for stopping the butterfly valve 5 at the valve stop position passed over the valve full close position when the engine stops. In this case, the valve stop position is a position, at which the butterfly valve 5 is rotated by a predetermined rotation angle from the valve full close position in the valve closing direction. The return spring applies a force to the butterfly valve 5 in the returning direction from the valve full open position to the valve stop position across the valve full close position.

The equipment includes two protrusions (i.e., protruding portions, that are guides such as a rib) 71, 72 as the ring outer diameter holding means. The ring outer diameter holding means holds the outer diameter of the seal ring 7 to be equal to the inner diameter of the nozzle 4 at the valve stop position when the engine stops. Specifically, the protrusions 71, 72 limit the outer diameter of the seal ring 7 not to expand to be larger than the inner diameter of the nozzle 4 in a range between the valve full close position and the valve stop position. These guides 71, 72 are integrally formed to protrude to a center axial side of the emission gas recycling passage 1 from the inner diameter surface of the nozzle 4. Further, a concavity 73, 74 is formed on the top end surface of each guide 71, 72. The concavity 73, 74 has a substantially spherical shape corresponding to the outline shape of the seal ring 7.

Thus, the inner diameter surface of the nozzle 4 except for the guides 71, 72 according to this embodiment has no contact portion between the outer diameter surface of the seal ring 7 and the inner diameter surface of the nozzle 4 so that a clearance having a substantially circular arc shape is formed between the outer diameter surface of the seal ring 7 and the inner diameter surface of the nozzle 4. Therefore, the deposit is prevented from depositing to bridge between the inner diameter surface of the nozzle 4 and the seal ring 7. Further, the fixing strength between the inner diameter surface of the nozzle 4 and the seal ring 7 is reduced. Further, even if the seal ring 7 is adhered to the outer diameter periphery of the butterfly valve 5 by the adhesion and/or the deposition of the deposit after the engine stops, the butterfly valve 5 can be returned from the valve stop position to the valve full close position. This is because the outer diameter periphery of the seal ring 7 does not catch on the inner diameter surface of the nozzle 4 when the engine starts since the inner diameter of the nozzle 4 is almost equal to the outer diameter of the seal ring 7. Accordingly, the butterfly valve 5 can be operated to open and to close smoothly after the engine starts, so that the emission gas recycling amount (i.e., the EGR amount) can be optimized in accordance with the driving condition of the engine.

Further, the equipment can include a power unit such as a driving motor instead of the return spring as the valve position holding means. The driving motor stops the butterfly valve 5 at the valve stop position passed over the valve full close position when the engine stops or after the engine stops. The vale stop position is a position, at which the butterfly valve 5 is rotated by a predetermined rotation angle from the valve full close position in the valve closing direction.

Third Embodiment

Figure 5A:
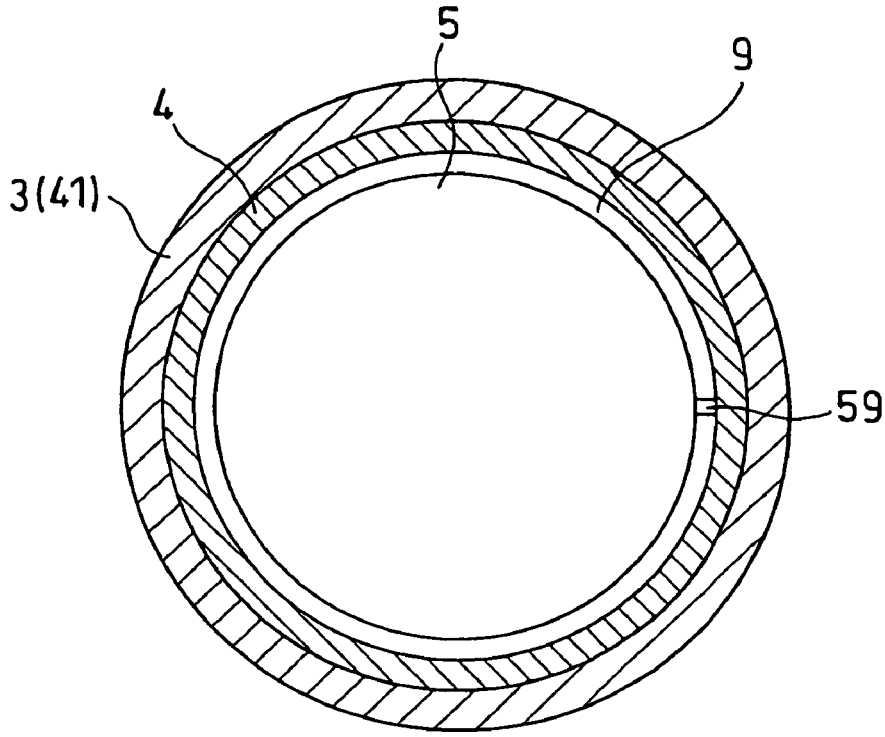
FIGS. 5A and 5B are cross sectional views showing a main part of a recycling emission gas amount control valve in emission gas recycling equipment according to a third embodiment of the present invention.
Figure 5B:
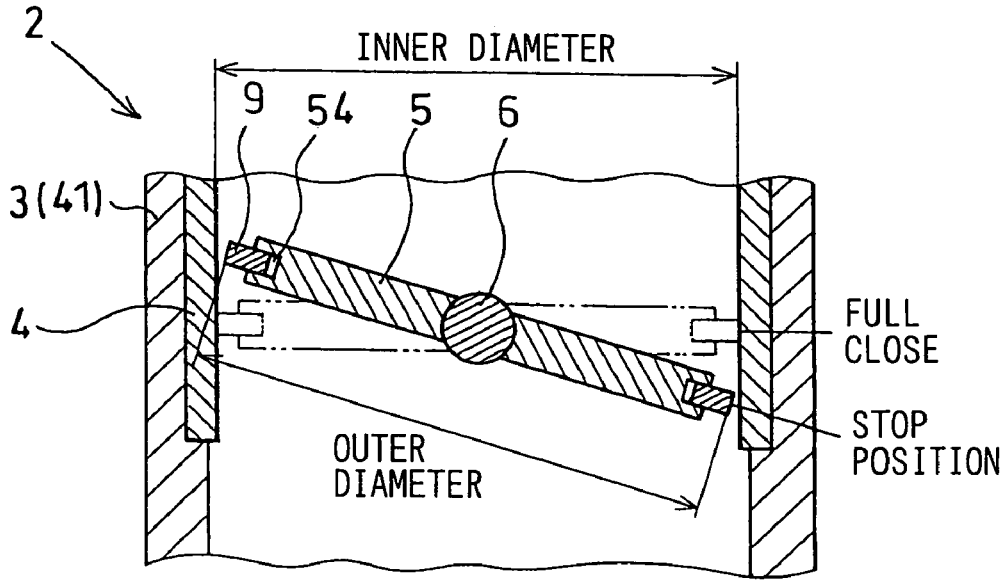

FIGS. 5A and 5B show a main part of an emission gas recycling amount control valve in emission gas recycling equipment according to a third embodiment of the present invention.

Emission gas recycling equipment according to this embodiment includes a return spring (not shown) as valve position holding means for stopping the butterfly valve 5 at the valve stop position passed over the valve full close position when the engine stops, similar to the second embodiment. In this case, the valve stop position is a position, at which the butterfly valve 5 is rotated by a predetermined rotation angle from the valve full close position in the valve closing direction. The return spring applies a force to the butterfly valve 5 in the returning direction from the valve full open position to the valve stop position across the valve full close position.

Further, the equipment includes a seal ring construction as the ring outer diameter holding means. The ring outer diameter holding means holds the outer diameter of the seal ring 9 to be equal to the inner diameter of the nozzle 4 at the valve stop position when the engine stops. Specifically, the seal ring construction limits the elastic deformation direction of the seal ring 9 to the inner diameter side of the seal ring 9 in the radial direction.

Thus, the butterfly valve 5 is stopped at the valve stop position when the engine stops. No contact portion is formed between the inner diameter surface of the nozzle 4 and the outer diameter surface of the seal ring 9 so that a predetermined clearance having a ring shape is formed between the inner diameter surface of the nozzle 4 and the outer diameter surface of the seal ring 9. Therefore, the deposit is prevented from depositing to bridge between the inner diameter surface of the nozzle 4 and the seal ring 9 so that the adhesion of the seal ring 9 to the inner diameter surface of the nozzle 4 is prevented. Further, even if the seal ring 9 is adhered to the outer diameter periphery of the butterfly valve 5 by the adhesion and/or the deposition of the deposit after the engine stops, the butterfly valve 5 can be returned from the valve stop position to the valve full close position. This is because the outer diameter periphery of the seal ring 9 does not catch on the inner diameter surface of the nozzle 4 when the engine starts since the inner diameter of the nozzle 4 is almost equal to the outer diameter of the seal ring 9. Accordingly, the butterfly valve 5 can be operated to open and to close smoothly after the engine starts, so that the emission gas recycling amount (i.e., the EGR amount) can be optimized in accordance with the driving condition of the engine.

Further, the equipment can include a power unit such as a driving motor instead of the return spring as the valve position holding means. The driving motor stops the butterfly valve 5 at the valve stop position passed over the valve full close position when the engine stops or after the engine stops. The vale stop position is a position, at which the butterfly valve 5 is rotated by a predetermined rotation angle from the valve full close position in the valve closing direction.

Furthermore, the equipment can include outer diameter side deformation limiting means (e.g., a convexity having a hook shape for hooking on a concavity formed on a sidewall of the seal ring) as the ring outer diameter holding means. The outer diameter side deformation limiting means limits the elastic deformation of the seal ring to the outer diameter side of the seal ring in the radial direction so that the outer diameter of the seal ring does not expand to be larger than the inner diameter of the nozzle 4 at the valve stop position.

(Modifications)

In the above embodiments, the nozzle 4 is engaged to and accommodated in the inner circumference of the nozzle joint 41 in the valve housing 3, and further, the butterfly valve 5 is accommodated in the nozzle 4 to be openable and to closable. The butterfly valve 5 can be accommodated in a valve accommodation space of the valve housing 3 to be openable and closable. The valve accommodation space has a substantially circular pipe shape. In this case, the nozzle 4 is not required, and therefore, the number of parts of the equipment and the number of assembling processes can be reduced. Further, in the above embodiments, the butterfly valve 5 of the EGR control valve 2 is fixed and mounted on the valve mount 56 in the valve shaft 6 by the fixation means such as welding method. The EGR control valve 2 controls the emission gas recycling amount (i.e., the EGR amount) of the EGR gas continuously or stepwise in accordance with the driving condition of the engine. The butterfly valve 5 can be mounted and screwed on the valve mount 56 of the valve shaft 6 with a screw such as a connection screw and a fixation bolt.

In the first embodiment, the butterfly valve 5 is operated to open and to close only one cycle across the valve full close position when the engine stops (or after the engine stops). After that, the butterfly valve 5 is stopped at the valve full close position (i.e., the valve stop position in a case where the engine is shut off). The butterfly valve 5 can be operated to open and to close more than one cycle across the valve full close position when the engine stops or after the engine stops. After that, the butterfly valve 5 is stopped at the valve full close position (i.e., the valve stop position in a case where the engine is shut off).

In the second and third embodiments, the butterfly valve 5 is stopped at the valve stop position passed over the valve full close position when the engine stops (or after the engine stops). The butterfly valve 5 can be operated to open and to close across the valve full close position only one cycle when the engine stops or after the engine stops, and then, the butterfly valve 5 can be stopped at the valve stop position passed over the valve full close position.

Such changes and modifications are to be understood as being within the scope of the present invention as defined by the appended claims.

What is claimed is:

1. Emission gas recycling equipment comprising:

an emission gas recycling passage for recycling a part of an emission gas from a combustion engine to an air intake side of the engine; and a recycling emission gas amount control valve for controlling an amount of the part of the emission gas, which is recycled into the air intake side through the emission gas recycling passage, wherein the recycling emission gas amount control valve includes:

a housing having a pipe portion to provide a part of the emission gas recycling passage;

a butterfly valve rotatable in a valve opening direction and a valve closing direction with respect to a rotation center axis, wherein the butterfly valve is accommodated in the pipe portion to be openable and closable in a rotational angle range between a valve full open position and a valve stop position, at which the butterfly valve is rotated by a predetermined degree from the valve full open position;

a seal ring having a substantially ring shape for sealing a ring shape clearance by using an elastic deformation force in a radial direction, wherein the ring shape clearance is formed between an inner wall of the pipe portion and an outer wall of the butterfly valve in a case where the butterfly valve is positioned at the valve full close position, and wherein the seal ring is accommodated in an outer diameter portion of the butterfly valve;

valve position holding means for stopping the butterfly valve at the valve stop position passed over the valve full close position at the time when the engine stops or after the engine stops; and ring outer diameter holding means for holding an outer diameter of the seal ring to be equal to an inner diameter of the pipe portion at the valve stop position.

2. The emission gas recycling equipment according to claim 1, wherein the valve position holding means includes a return spring, which applies a force to the butterfly valve in a returning direction from the valve full open position to the valve stop position.

3. The emission gas recycling equipment according to claim 1, wherein the valve position holding means includes a power unit for rotating the butterfly valve in the valve closing direction and the valve opening direction.

4. The emission gas recycling equipment according to claim 1, wherein the valve position holding means is capable of stopping the butterfly valve at the valve stop position after the valve position holding means rotates the butterfly valve to open and to close equal to or more than one cycle across the valve full close position at the time when the engine stops or after the engine stops.

5. The emission gas recycling equipment according to claim 4, wherein the valve position holding means is capable of rotating the butterfly valve from the valve full open position to the valve stop position across the valve full close position equal to or more than one cycle at the time when the engine stops or after the engine stops.

6. The emission gas recycling equipment according to claim 1, wherein the ring outer diameter holding means is a protrusion for limiting an outer diameter of the seal ring not to expand to be larger than the inner diameter of the pipe portion, the protrusion is disposed between the valve full close position and the valve stop position, and disposed on an inner wall of the pipe portion, the protrusion includes a concavity having a spherical shape corresponding to an outline shape of the seal ring, and the concavity is disposed on a top surface of the protrusion.

7. The emission gas recycling equipment according to claim 1, wherein the ring outer diameter holding means has a seal ring construction for limiting an elastic deformation direction of the seal ring to an inner diameter side of the seal ring in a radial direction.

8. The emission gas recycling equipment according to claim 1, wherein the ring outer diameter holding means is outer diameter side deformation limiting means for limiting an elastic deformation of the seal ring to an outer diameter side of the seal ring in a radial direction not to expand the outer diameter of the seal ring larger than the inner diameter of the pipe portion at the valve stop position.

9. The emission gas recycling equipment according to claim 1, wherein the seal ring has an outer diameter periphery in the radial direction, and the outer diameter periphery is chamfered for operating the butterfly valve to open and to close easily.

* * * * *